United States Patent [19]

Letiche

[11] Patent Number: 4,991,152

[45] Date of Patent: Feb. 5, 1991

[54] ELECTROACOUSTIC TRANSDUCER, USABLE IN PARTICULAR AS A SOURCE OF ACOUSTIC WAVES FOR SUBMARINE APPLICATIONS

[75] Inventor: Michel Letiche, Antibes, France

[73] Assignee: Thomson CSF, Puteaux, France

[21] Appl. No.: 380,478

[22] Filed: Jul. 7, 1989

[30] Foreign Application Priority Data

Jul. 8, 1988 [FR] France ..... 88 09302

[51] Int. Cl.[5] ..... H04R 17/00

[52] U.S. Cl. ..... 367/158; 310/337

[58] Field of Search ..... 310/325, 337, 354, 370; 367/157, 158, 164, 165

[56] References Cited

U.S. PATENT DOCUMENTS

| | | | |
|---|---|---|---|
| 3,311,873 | 3/1967 | Schloss | 367/158 |
| 3,320,582 | 5/1967 | Sykes | 367/158 |
| 4,731,764 | 3/1988 | Ponchaud | 367/158 |
| 4,827,459 | 5/1989 | Franklin | 310/337 X |

*Primary Examiner*—Brian S. Steinberger

*Attorney, Agent, or Firm*—Cushman, Darby & Cushman

[57] ABSTRACT

This electroacoustic transducer has a structure of the so-called "Tonpilz" general type, i.e., comprising a radiating horn, a rear mass and a motor formed by at least one piezoelectric element interposed between said horn and said rear mass, and electrically excited so as to produce a vibration transmitted to the horn. Said piezoelectric element is submitted to an electric field with a direction perpendicular to the main direction of polarization of said piezoelectric material so as to stress the latter in the shear mode. Said horn and rear mass are terminated one in the form of a foot and the other in the form of a U accommodating said foot between rectilinear arms, the foot and arms extending parallel to the longitudinal direction of the transducer, and said motor being formed by substantially parallelepipedal piezoelectric elements disposed between the facing sides of said foot and of each arm, these elements being fitted with electrodes creating an electric field parallel to said longitudinal direction, and the shape of said piezoelectric elements being chosen so as to promote the strain of the piezoelectric material substantially in this longitudinal direction. This configuration allows to considerably lower the resonant frequency of the assembly with moderate overall size and weight and with a small volume of piezoelectric material.

11 Claims, 1 Drawing Sheet

ELECTROACOUSTIC TRANSDUCER, USABLE IN PARTICULAR AS A SOURCE OF ACOUSTIC WAVES FOR SUBMARINE APPLICATIONS

BACKGROUND OF THE INVENTION

The present invention relates to an electroacoustic transducer, usable in particular as a source of acoustic waves for submarine applications such as the detection of mines, sonar recognition of seam botton, etc.

The transducer according to the present invention is of the so-called "Tonpilz" ("acoustic mushroom") type, i.e., a type comprising essentially a radiating horn (hence its name), a rear mass and a motor made up of at least one piezoelectric element (in general, a ceramics or a stack of ceramics) disposed between the horn and the rear mass, and electrically excited so as to produce a vibration transmitted to the horn.

Such a transducer of the Tonpilz type is described, for example, in the French patent application No. FR-A-2 085 545.

However, the tranducers of this type have a poor operation and a low efficiency at low frequencies (that is at frequencies of about a few kilohertz).

As a matter of fact, in these transducers the resonant frequency of the mass/spring assembly formed, for one, by the rear mass and the horn, and for another, by the piezoelectric element is given by the following expression:

$$fr:\tfrac{1}{2}[(m1+m2)/(e\times m1m2)]^{\frac{1}{2}} \quad (1)$$

Where e is the overall elasticity of the motor (that is the elasticity of the piezoelectric element), m1 the mass (or weight) of the horn, and m2 the weight of the rear mass.

It can be seen that if it is desired to transmit at low frequencies, it is necessary to increase the elasticity e of the motor and, to a smaller extent, the weight m1 and m2 in order to sufficiently lower the resonant frequency of the mass-spring assembly.

Now, the elasticity e of the spring depends on the shape and the size of the piezoelectric elements of the motor as well as on the piezoelectric material employed, this elasticity being given by the expression:

$$e=(l/S)s \quad (2)$$

where l is the length of the piezoelectric element in the direction of polarization, S is the active area, i.e., the area of the piezoelectric element in contact with the horn and with the rear mass, and s is the compliance of the piezoelectric material being used.

It can be seen that, to sufficiently lower the resonant frequency, it is necessary to have a high l/S ratio, that is relatively long—and consequently bulky and heavy—transducers, for it is not desired to decrease S too much, in particular because of the appearance of parasitic modes of radiation in the horn resulting in particular from flexural strains thereof. This is in particular the case of the transducer described in the above-mentioned patent application No. FR-A-2 085 545.

In addition it is necessary that the limit acoustic power be higher than the cavitation power, which always leads to a minimum volume of ceramic material.

Furthermore, there are for any piezoelectric element (in particular for a ceramics) two main modes of operation, namely:

the compresssion-extension mode, when the ceramics is polarized perpendicularly to the electrodes (i.e., the direction of polarization own to the piezoelectric material is parallel to the electric field created by the electrodes).

This mode of operation is that generally used for the Tonpilz transducers (in particular that of the above-mentioned FR-A-2 085 545).

The strain of the piezoelectric material takes then place substantially in the direction of the electric field, this direction corresponding in the above-mentioned patent to the longitudinal direction of the stack of piezoelectric elements, and this strain producing a relative closing and spacing motion of the horn and the rear mass as they are connected to the opposite ends of the stack.

the shear mode, when the dielectric material is polarized parallel to the ellectrodes (i.e., its direction of polarization is perpendicular to the electric field created by the electrodes).

In this mode of operation, two types of strain are possible: one in a direction perpendicular to the electric field, and the other in a direction parallel to this field, one of the two types being promoted depending on the shape given to the element.

It has been found that for one and the same dielectric material, the compliance $S_{44}$ in the shear mode is very higher than the complinace $S_{33}$ in the compression mode—typically two to three times higher.

The coupling coefficients $k_{33}$ and $k_{15}$ are furthermore substantially the same in the compression mode and in the shear mode (this coefficient defines the efficiency of the conversion of electric energy into mechanical energy (and conversely) that this material performs).

One may be led to think that for manufacturing a transducer with the same resonant frequency but having a lower weight and a smaller volume, or for manufacturing a transducer having a lower resonant frequency for the same weight and volume, it would be interesting to use the piezoelectric material in the shear mode since a much higher elasticity (see the relationship (2) above) will be obtained while retaining a substantially identical conversion efficiency.

Such an attempt has been suggested in the patent application No. US-A-4 072 871 that describes a transducer including rings of piezoelectric material stressed in the shear mode, and in which the strain in the direction perpendicular to the electric field is promoted.

A number of annular parts permit to pinch the piezoelectric elements by connecting them to the horn and to the rear mass while promoting the shear mode.

The major disadvantage of this transducer of the prior art is that the active area—in the sense indicated above, i.e., the total area in contact (here in indirect contact) with the horn and the rear mass—is very large. More precisely, in this transducer of the prior art, this active surface is equal to the product of the circumference of the annular piezoelectric element by the height thereof. It follows, from the explanations given above, that with this configuration of the prior art, the elasticity e remains low and that consequently this transducer is rather not suited to the generation or the reception of the lowest frequencies.

Another disadvantage is that the electrodes, sandwiched between the piezoelectric elments and the annular parts connected to the horn or to the rear mass, are therefore in contact with these annular parts, so that the latter must be made of a non-conducting material and consequently cannot be an integral part of the horn or the rear mass, which complicates the structure and the construction of the transducer.

SUMMARY OF THE INVENTION

An object of the present invention is a transducer allowing to eliminate these disadvantages and that can operate at very low frequencies thanks to a very low resonant frequency (about a few kilohertz), while permitting a considerable reduction of the volume of piezoelectric material and a weight saving for the horn and the rear mass.

It will also be seen that the structure of this transducer is extremely simple, which allows to construct rugged and reliable devices at a very low cost.

To this end, the present invention proposes a transducer of a type similar to the above-mentioned Tonpilz type, but designed to be stressed in the shear mode, and whose structure permits to use bars of piezoelectric material for which the contact area S is minimized by promoting the strain in a direction parallel to the electric field, i.e., with a configuration opposite to that of the transducer of the patent application No. US-A-4 072 871 mentioned above.

More precisely and in a manner characteristic of the present invention, the horn and the rear mass are terminated one in the form of a rectilinear foot, and the other in form of a U accomodating the foot between rectilinear arms, the foot and the arms extending parallel to the longitudinal direction of the transducer, and for another, the motor is formed by substantially parallelepipedal piezoelectric elements placed between the facing sides of the foot and of each arm, these piezoelectric elements being fitted with electrodes creating an electric field parallel to said longitudinal direction, and the shape of these piezoelectric elements being chosen so as to promote the strain of the piezoelectric material substantially in this longitudinal direction.

Preferably, it is the horn which is terminated in the form of a foot and the rear mass is terminated in the form of a U.

Advantageously, on each piezoelectric element, the electrodes are disposed on either side of the piezoelectric element in the longitudinal direction, respectively on the front and rear sides thereof, and the width, in the transverse direction, of the front and rear electrodes is smaller than the width of the piezoelectric element in this direction, which leaves a space between the electrode and the foot and/or beween the electrode and the arm of the U, whereby the foot and/or the arm of the U can be made of a metallic material.

Very advantageously, to achieve the desired mode of operation, the length of the piezoelectric elements in the longitudinal direction is at least the double of their width in the transverse direction, and this width in the transverse direction of the piezoelectric elements is at least the double of their width in the direction perpendicular to the longitudinal direction and to the transverse direction.

The structure of the present invention allows to easily provide, if necessary, means for prestressing the piezoelectric elements in the transverse direction with, for example, a tie bolt passed in aligned holes transversally oriented and provided in the foot, the piezoelectric elements and the arms of the U.

Preferably, the cross-sectional area of the horn is at least ten times larger than the cross-sectional area of the foot.

BRIEF DESCRIPTION OF THE DRAWINGS

Other features and advantages of the present invention will become apparent from the following detailed description of preferred embodiments given as a non-limitative example with reference to the accompanying drawings, in which.

DESCRIPTION OF THE PREFERRED EMBODIMENTS

Figure 1:
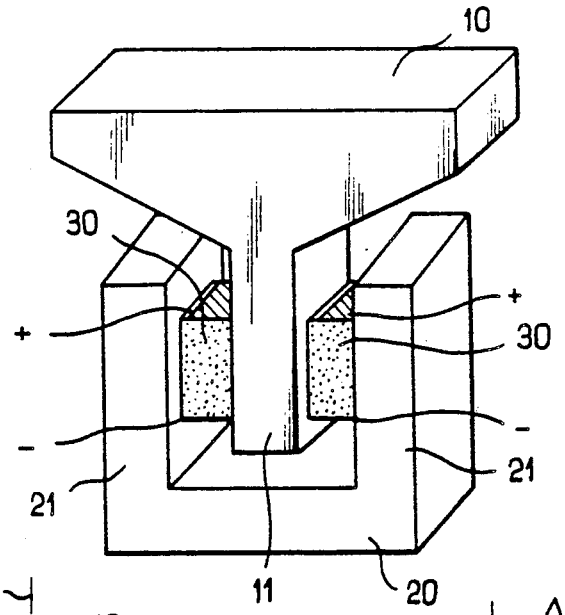
FIG. 1 is a schematic perspective view of the transducer according to the present invention.

The schematic diagram in FIG. 1 shows the horn 10 lengthened at the rear by a foot 11 with a rectangular cross section, the rear mass 20 being terminated at the front by two arms 21, with piezoelectric elements 30 interposed between the horn 10 and the rear mass 20.

The diameter of the horn is generally equal to a half-wavelength and, to avoid the flexion phenomena, the ratio between the area of the horn and that of foot cross section is lower than ten, which permits to have a minimum volume for the horn-foot assembly.

The horn 10 has its foot 11 disposed between the arms 21 of the rear mass 20, and these two parts are coupled through the piezoelectric elements 30 forming the motor of the transducer, these piezoelectric elements having the form of a bar and being placed between the respective facing sides of the foot 11 and of each of the arms 21.

Figure 2:
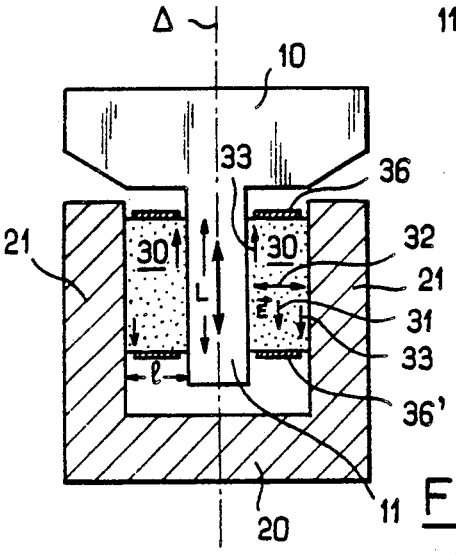
FIG. 2 is a plan view corresponding to FIG. 1, illustrating the manner in which the piezoelectric elements are excited.

The piezoelectric elements 30 are oriented so that their main direction of polarization, indicated by the arrow 32 in FIG. 2, extends transversally, i.e., in the direction perpendicular to the longitudinal axis Δ of the transducer and that extends in a plane containing the foot 11 and the arms 21 (a plane which is the plane of the Figure in the case of FIG. 2).

The piezoelectric elements are submitted to an electric field E parallel to the transverse direction to Δ, i.e., oriented in a direction 31 perpendicular to the direction of polarization 32.

The fact that these two directions and perpendicular to each other allows, as explained above, to stress the piezoelectric elements in the shear mode.

Furthermore, the ceramic bars have an elongated shape with a length in the longitudinal direction longer than the width l in the transverse direction. This allows, among the two possible types of strain indicated above, to promote that (indicated by the arrows 33 and 33') which takes place in a direction parallel to the direction 31 of the electric field E.

Figure 4:
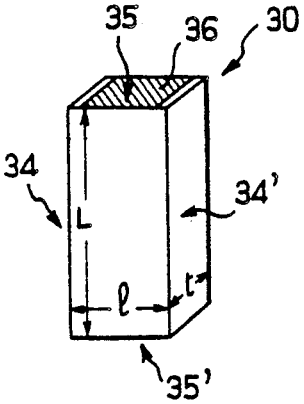
FIG. 4 shows the isolated piezoelectric element.

To this end, the length L of the piezoelectric element is, preferably, at least equal to twice its width l, and this width l is in addition equal to at least twice the thickness t (all dimensions are shown in FIG. 4).

Figure 3:
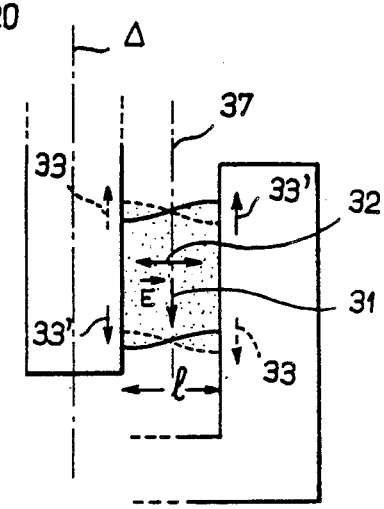
FIG. 3 is a detail of FIG. 2, illustrating the modes of vibration of the piezoelectric elements.

FIG. 3 explains the operation of the motor by illustrating the strains in a direction (arrow 33) and is the opposite direction (arrow 33') of the piezoelectric element stressed in the shear mode. This system is equivalent to a mass-spring system in which the mass is constituted by the weights m1 and m2 of the horn and the rear mass, and the spring by the piezoelectric element exhibiting an own elasticity e (that, as indicated above, is high in the shear mode). This system has a locus of nodal points aligned along the straight line 37 whose distance to the longitudinal axis Δ is determined by the ratio of the weights m1 and m2 of the horn and the rear mass.

It should be noted that, thanks to the configurtion of the present invention, the transverse vibration (generating parasitic modes) is very low due to the bar shape of the piezoelectric element, this bar being blocked in the transverse direction by the arms of the rear mass and by the foot of the horn.

FIG. 4 shows the isolated bar : both lateral sides 34 will be adhesively bonded, one to the foot 11 of the horn and the other to one of the arms 21 of the rear mass, and the front and rear sides 35, 35' receive the electrodes 36, 36'.

As can be seen, these electrodes are "free", i.e., they are in contact only with the ceramic bar. Their width is slightly shorter than the width l of the bar, leaving a space avoiding any contact with the horn 10 and the rear mass 20.

In this way, both of those elements can be constructed without difficulty in a solid metallic material and have each a monobloc structure.

Figure 5:
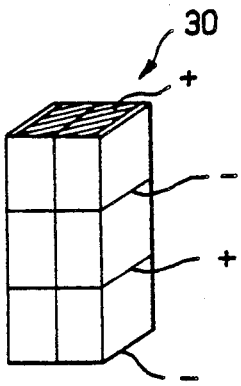
FIG. 5 is homologous to FIG. 4 for a piezoelectrid element formed by a plurality of ceramic blocks of smaller size joined and stacked.

Furthermore, the piezoelectric element can be constructed, as shown in FIG. 5, from several ceramic parts assembled by adhesive bonding, all with the same orientation of the direction of polarization. An electrode is then provided at each transverse interface to avoid to have to polarize a too long length of piezoelectric material.

Figure 6:
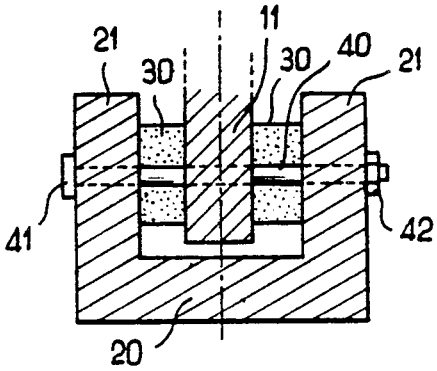
FIG. 6 shows a means for achieving in a simple manner the prestressing of the piezoelectric elements.

In addition, it is possible to prestress the piezoelectric elements by means of a transverse bar passed, as shown in FIG. 6, in a series of aligned transverse holes provided in each of the two arms 21, in the foot 11 and in each of the piezoelectric elements 30. The head 41 of the bolt rests on the outer side of one of the arms while a nut 42, whose tightening is adjusted depending on the desired prestress, rests on the outer side of the other arm.

It should be noted that the configuration just described in detail is optimum but is not limitative and that other configurations operating on the same principle could be envisaged.

Thus, there can be provided that, while retaining the same structure, it is the horn that carries the arms and the rear mass the carries the foot, all other things being equal. However, this configuration would be less interesting to the extent in which it would decrease the weight of the rear mass (that one must endeavour to make as heavy as possible) and might in addition produce parasitic modes of radiation.

Similarly, although the system described above has two arms, one could envisage without departing from the basic principles of the invention, a system that, while retaining a symmetry about the longitudinal axis Δ, has a higher number of arms, or even a system in which the various arms surrounding the foot are joined, thus forming a prismatic contour.

However, by increasing the number of piezoelectric elements, one incurs a loss of elasticity due to the fact that this increases the "active area" defined above.

There will now be described an embodiment showing the advantages provided by the present invention over a conventional Tonpilz transducer.

DESCRIPTION OF A PRACTICAL EMBODIMENT

Efforts were made to obtain a transducer that be optimized in weight and volume for a given resonant frequency and a given frequency band.

If we choose, for example:

a resonant frequency of 3 kHz, a horn diameter of 250 mm (one half-wavelength), a mechanical quality factor Q=2, and a ratio between the area of the horn and the area of the portion where the foot is joined with the motor (i.e., the cross-sectional area of the motor in a conventional Tonpilz or the cross-sectional area of the foot in the transducer according to the invention) of about 10, we obtain the following characteristics for a conventional Tonpilz transducer optimized in weight and volume:

| | |
|---|---|
| minimum front mass weight: | 2.2 kg |
| volume of the piezoelectric material: | 840 $cm^3$ |
| weight of the piezoelectric material: | 6.13 kg |
| front mass weight: | 3.44 kg |
| rear mass weight: | 10.95 kg |
| (that is a total weight of 20.52 kg). | |

The motor, made up of a cylindrical stack, will have a 72.5-mm diameter and a 203.5-mm height.

A transducer constructed according to the present invention will have the following characteristics for the same performance and the same piezoelectric material:

| | |
|---|---|
| minimum front mass weight: | 3.3 kg |
| volume of the piezoelectric material: | 126 $cm^3$ |
| weight of the piezoelectric material: | 0.92 kg |
| front mass weight: | 4.11 kg |
| rear mass weight: | 7.30 kg |
| (that is a total weight of 12.33 kg). | |

The dimensions given to the piezoelectric element in this example are : L=96 mm, l=38.5 mm and t=17 mm.

The front mass can advantageously be made of a lightweight material such as aluminum, and the rear mass of a dense and rigid material such as steel. The adhesive bonding of the piezoelectric elements can be accomplished, in a conventional manner, by means of an epoxy adhesive whose mechanical strength must be at least equal to the peak load to which the piezoelectric material may be submitted.

There is a considerable saving—in a 1:6.7 ratio—in the necessary volume of piezoelectric material, therefore a significant cost reducltion for the transducer.

There is also a reduction both of the total mass of the transducer—in a ratio near to 2—and of its size, in particular thanks to the reduced height, due to a lower height of the motor (the length of the bar is 96 mm instead of a stack height of 203.5 mm).

What is claimed is:

1. An electroacoustic transducer, comprising a radiating horn, a rear mass and a motor formed by at least one piezoelectric element interposed between said horn and said rear mass, and electrically excited so as to produce a vibration transmitted to the horn, in which said piezoelectric element is submitted to an electric field having a direction perpendicular to the main direction of polarization of the piezoelectric material so as to stress said piezoelectric material in accordance with a shear mode, wherein:

said horn and said rear mass are terminated one in the form of a rectilinear foot and the other in the form of a U accommodating said foot between rectilinear arms, said foot and said arms extending parallel to the longitudinal direction of the transducer, and said motor comprises substantially parallelepipedal piezoelectric elements disposed between facing sides of the foot and of each arm, said piezoelectric elements being fitted with electrodes creating an electric field parallel to said longitudinal direction, and the shape of said piezoelectric elements being chosen so as to strain the piezoelectric material substantially in said longitudinal direction.

2. A transducer according to claim 1, wherein said horn is terminated in the form of a foot, and said rear mass is terminated in the form of an U.

3. A transducer according to claim 1, wherein on each piezoelectric elements, the electrodes are disposed on either side of said piezoelectric element in the longitudinal direction, on the front and rear sides thereof, respectively.

4. A transducer according to claim 3, wherein the width, in the transverse direction, of said front and rear electrodes is less than the width of the piezoelectric element in this direction.

5. A transducer according to claim 4, wherein said length in the longitudinal direction of the piezoelectric elements is at least the double the width of the piezoelectric elements in the transverse direction.

6. A transducer according to claim 5, wherein the width in the transverse direction of the piezoelectric elements is at least the double the thickness of the piezoelectric elements in the direction perpendicular to the longitudinal direction and to the transverse direction.

7. A transducer according to claim 6, further includidng means for prestressing said piezoelectric elements in the transverse direction.

8. A transducer according to claim 7, wherein said means for prestressing the piezoelectric elements comprise a tie passed in aligned holes transversally oriented and provided in the foot, the piezoelectric elements and the arms of the U.

9. A transducer according to claim 2, wherein the cross-sectional area of said horn is at least ten times larger than the cross-sectional area of its foot.

10. A transducer according to claim 4 wherein said foot is made of a metallic material.

11. A transducer according to claim 4 wherein said arm is made of a metallic material.

* * * * *